United States Patent [19]

Deconinck

[11] 4,341,417

[45] Jul. 27, 1982

[54] ARTICLE OF FURNITURE WITH INCLINABLE BACK

[75] Inventor: Didier Deconinck, Seyssins, France

[73] Assignee: Allibert Exploitation, Grenoble, France

[21] Appl. No.: 158,112

[22] Filed: Jun. 10, 1980

[30] Foreign Application Priority Data

Jun. 11, 1979 [FR] France ..... 79 15863

[51] Int. Cl.[3] ..... A47C 4/40

[52] U.S. Cl. ..... 297/24; 297/355; 297/357; 297/443

[58] Field of Search ..... 297/357, 355, 354, 377, 297/24–26, 19, 56, 443

[56] References Cited

U.S. PATENT DOCUMENTS

| | | | |
|---|---|---|---|
| 631,176 | 8/1899 | Pinnock | 297/26 |
| 719,908 | 2/1903 | Truesdell | 297/56 |
| 2,914,117 | 11/1959 | Underwood | 297/19 X |

FOREIGN PATENT DOCUMENTS

| | | | |
|---|---|---|---|
| 1304459 | 8/1962 | France | 297/24 |
| 449617 | 7/1949 | Italy | 297/56 |
| 2011779 | 7/1979 | United Kingdom | 297/443 |

*Primary Examiner*—William E. Lyddane

*Attorney, Agent, or Firm*—Karl F. Ross

[57] ABSTRACT

An article of furniture having a seat of a generally constant orientation but a back which can be tilted at various angles has a generally X-shaped relationship of the seat and back and, on each side a pair of horizontally spaced pins, affixed to the seat, one of which rides on the upper surface of a cooperating member of the back while the other can be selectively fitted into notches of a rack structure on the lower edge of the respective member. The upper edge or surface of these members have a cam configuration and the distance separating this edge from the bottoms of each of the respective notches is progressively increased downwardly along the rack so that the seat inclination is substantially constant for all positions in which the pins engage the notches.

4 Claims, 3 Drawing Figures

ARTICLE OF FURNITURE WITH INCLINABLE BACK

FIELD OF THE INVENTION

The present invention relates to an article of furniture and, more particularly, a seating or like unit adapted to have its back rest adjusted to assume various inclinations to the floor or ground surface upon which the unit rests.

BACKGROUND OF THE INVENTION

Seating units, e.g. recliners and like articles of furniture, have been made in the past with a generally X configuration between the seat member and a back member or back rest such that the seat is generally inclined downwardly and rearwardly toward the floor so that its member has a relatively high front edge and a rear edge which forms one of the floor purchases. The back rest or back member, on the other hand, is inclined downwardly and forwardly so that its front edge or portion forms the other purchase on the floor while its upper portion extends above the seating surface to form a rest for the back of the user.

Each of these members can have a pair of lateral elements spanned by web, wicker, fabric or even rigid members which collectively define the seating and back rest surfaces.

On each side, the seat member and the back member can be provided with a respective element such that two elements are swingable relative to one another and one can be provided with one or more pins while the other is formed with one or more racks to allow relative sliding and pivotal displacement of the seat member and the back member. The elements of the seat member can be spanned by webbing, wicker, fabric or even rigid members defining the seating surface and back rest surface respectively.

To vary the inclination of the back rest member, the latter is shifted relative to the seat member by one or more notches or teeth of the respective rack and indexed anew therein.

While such seating units have been known to be highly effective and versatile, being easily controlled, frequently they do not provide a sufficient degree of comfort because the inclination and therefore the height of the front edge of the seat member varies in dependence upon the position and orientation of the back member.

In other words, when the back is relatively elevated or upright, the seat is comparatively high and as the back is lowered, the seat tends to drop as well as the front edge approaches the ground.

The user thus tends to slide on the unit because the seat no longer maintains its original inclination and many users found the seat uncomfortable in reclining positions in which the back is relatively low.

It is also difficult to readily get off or on the seat.

OBJECTS OF THE INVENTION

It is the principal object of the present invention to provide a seat unit in which the disadvantages of the earlier systems are avoided.

Another object of the invention is to provide an article of furniture with an inclinable back which can be selectively positioned reliably and with ease, but wherein the seat member retains generally its orientation in all positions of inclination of the back member.

Another object of the invention is to provide a seating unit with increased comfort and ease of mounting and dismounting.

SUMMARY OF THE INVENTION

These objects and others which will become apparent hereinafter are attained, in accordance with the invention, in a seat unit of the type described, i.e. having a seat member and a back member which define generally an X shape and in which the forward lower portion of the back member forms the front purchase of the unit while the rear lower portion of the seat member forms the rear purchase thereof, the seat member having at least one pair of horizontally spaced pins between which an element of the back member is received, this element of the back member being formed with an indexing rack along its lower edge with notches selectively receiving the rear pin while the front pin rests upon the upper edge of this element.

According to the invention, the seat member is inclined downwardly from its front portion toward its rear portion in all positions of the seat member and advantageously maintains its inclination in all positions of the back member as a result of a cam configuration imparted to the upper edge of the aforementioned element of the back member, which upper edge is generally concave.

It has been found that the most effective results in this regard are obtained when the distance separating this upper edge from the bottom of each of the notches increases from the upper end of the rack or seat of notches toward the lower end of the rack. Advantageously, the bottom of each notch is tangent to a line parallel to the ground or floor surface and through the center of the pin which rests upon the upper edge of the aforementioned element.

Naturally, in most cases, the back member will have two such elements, one on each side of the unit, while the seat member will have side elements provided with pairs of pins on opposite sides of the unit.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
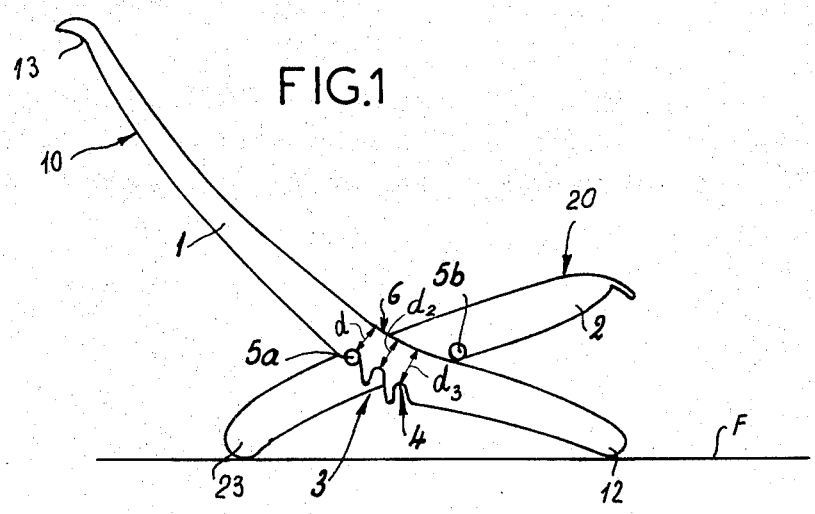
FIG. 1 is a diagrammatic side elevational view of a seat unit with the back member at its maximum inclination.
Figure 2:
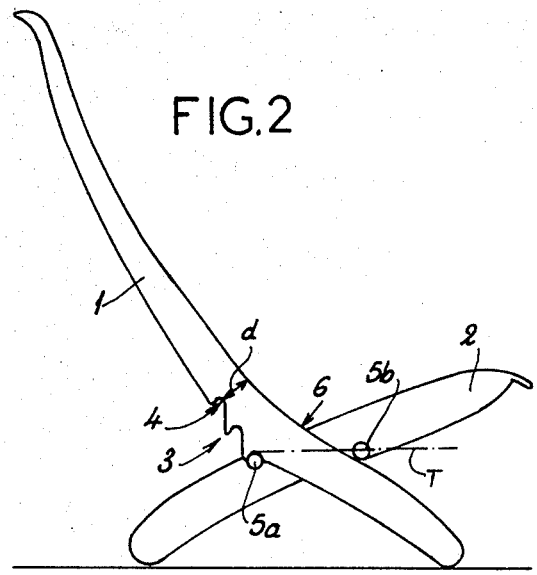
FIG. 2 is a similar view of the seat unit with the back member in its maximum elevation or most upright position.
Figure 3:
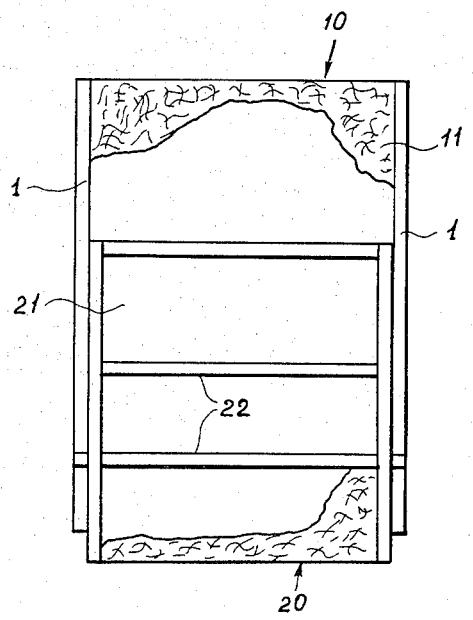
FIG. 3 is a plan view of the seat unit of FIGS. 1 and 2.

In FIGS. 1 and 2 of the drawing, one of the two elements 1 flanking the opposite sides of the back member 10 and one of the two elements 2 flanking the seating portion of the seat member 20 can be seen in the drawing to form an X shape. The elements 1 may be spanned by material 11 to form the back surface in any conventional manner and may be connected by rigid bars at the upper and lower ends of the seat member so that the lower portion 12 forms front feet for the seating unit resting upon the floor F. The upper portion 13 may be extended to support the full back, neck and head of the user or may have a somewhat shorter length.

The seat member 20 likewise can be covered at 21 and can have its two elements 2 connected by bars or rods 22 which can form the pins 5*a* and 5*b* which will be described below. The entire seat member with the elements 2 and the seating surface and the entire back member with the elements 1 can be formed by molding them from synthetic resin material, in which case connecting bars and surfacing fabric or wicker material can be eliminated.

As will be apparent from a comparison of FIGS. 1 and 2, the two members can form various angles between them, thereby permitting the back member 1 to assume various inclinations, means being provided to index the back member relative to the seat member in the several positions.

These means can include a rack 3 formed along the lower edges of each of the elements 1 and constituted by notches 4, three such notches being provided in the system shown in the drawing enabling three distinct inclinations of the back member to be established.

Each of the elements 2 associated with a respective back element 1, is provided with a pair of pins 5*a*, 5*b* spaced apart horizontally.

The lower portion 23 of the seat member 20 also rests upon the floor F.

Each rear pin 5*a* can be indexed in a respective notch 4 of the rack 3 of the corresponding element 1 while the other pin 5*b* rests upon the upper edge of the element 1. Adjustment between positions is effected simply by lifting the upper portion of the back member 10 to release the pin 5*a* from one of the notches and then moving back member until the pin engages another of these notches.

Once the pins 5*a* are seated in the notches, the respective elements 1, 2 are immobilized with respect to one another and in the uppermost notch as shown in FIG. 1, the pin 5*a* maintains the unit in its maximum open position with the back member highly inclined while the seat is itself significantly inclined rearwardly to the ground.

In the position shown in FIG. 2, the pin 5*a* is in the lower notch 4 of the rack and the unit is in a more closed position with the back somewhat more upright while the seat has substantially the same inclination as in the position shown in FIG. 1.

Thus, whatever the indexed inclination of the back member, the inclination of the seat member remains substantially the same. This is achieved by giving the upper edge of each of the elements 1 an upwardly concave cam shape and by making the distance d between the upper edge of the element 1 and the bottom of each notch greater from the uppermost notch at one end of the rack to the lowermost notch at the lower end of the rack. In FIG. 1, these distances have been represented at $d_1$, $d_2$ and $d_3$ which progressively increase. Furthermore, a tangent represented by the dot-dash line T between the bottom of each notch and the center of the pin 5*b* lies substantially parallel to the floor F.

What is claimed is:

1. A seating unit comprising:

a seat member and a back member interfitted in a generally X configuration so that a lower portion of said seat member and a lower portion of said back member form rear and front purchases for said unit on a floor, said seat member being inclined downwardly from a front thereof to its rear portion; and means for indexing said back member relative to said seat member in a plurality of selected angular positions corresponding to various inclinations of said back member while the inclination of said seat member relative to the floor is substantially constant, at least one of the sides of said back member being formed with an element extending between its lower portion and an upper portion of said back unit and formed with upper and lower edges, the corresponding side of said seat member being provided with a pair of horizontally spaced pins straddling said element, said means including a rack of notches formed along said lower edge and receiving selectively one of said pins, the other of said pins resting upon the upper edge of said element.

2. The seating unit defined in claim 1 wherein said upper edge of said pin has a cam shape constructed and arranged to maintain the inclination of said seat member constant for all inclinations of said back member corresponding to indexing of said one of said pins in each of said notches.

3. The seating unit defined in claim 2 wherein the distance between the bottom of each notch and the upper edge of said element increases from an upper end of said rack to a lower end thereof.

4. The seating unit defined in claim 3 wherein the bottom of each notch when said one of said pins is received therein is tangent to a line through the center of said one pin which is substantially parallel to the floor.

* * * * *